US005622103A

United States Patent [19]

Acosta et al.

[11] Patent Number: 5,622,103

[45] Date of Patent: Apr. 22, 1997

[54] DISPOSAL ASSEMBLY FOR FLUID FILTRATION DEVICES

[76] Inventors: Evelio Acosta, 8505 NW. 74 St., Miami, Fla. 33166; Lewis Goodman, 555 Reinante Ave., Coral Gables, Fla. 33156

[21] Appl. No.: 395,782

[22] Filed: Feb. 28, 1995

[51] Int. Cl.[6] ..... B30B 9/04; B30B 9/32

[52] U.S. Cl. ..... 100/7 R; 100/100; 100/110; 100/131; 100/249; 100/295

[58] Field of Search ..... 100/70 R, 94, 100/98 R, 100, 110, 131, 240, 249, 295

[56] References Cited

U.S. PATENT DOCUMENTS

| | | | |
|---|---|---|---|
| 2,594,054 | 4/1952 | McNamara et al. | 100/131 |
| 3,490,631 | 1/1970 | Smith | 100/100 |
| 3,538,844 | 11/1970 | Howard | 100/98 R |
| 3,604,179 | 9/1971 | Lund | 100/70 R |
| 3,992,986 | 11/1976 | Sutton | 100/249 |
| 4,057,010 | 11/1977 | Smith | 100/98 R |

FOREIGN PATENT DOCUMENTS

| | | | |
|---|---|---|---|
| 2427760 | 1/1976 | Germany | 100/98 R |

*Primary Examiner*—Stephen F. Gerrity

*Attorney, Agent, or Firm*—Gomer W. Walters; Jon Carl Gealow

[57] ABSTRACT

A waste disposal assembly for the simultaneous disposal of a plurality of fluid filtration devices, the assembly including a main disposal housing with a disposal storage area, a fluid storage area and, a processing area having an exterior access to allow loading of a plurality of fluid filtration devices into the processing area, a lid member to cover the processing area subsequent to the loading, a compactor face to compact the plurality of fluid filtration devices within the processing area thereby squeezing fluid from the fluid filtration devices and forming a compressed waste block which is thereafter separated so as to break up the compressed waste block within the processing area, and an interior access which is to be opened to receive the broken up compressed waste block therethrough for passage into the disposal storage area which is structured to contain a substantial quantity of the broken up compressed waste blocks until appropriate disposal is made.

17 Claims, 11 Drawing Sheets

DISPOSAL ASSEMBLY FOR FLUID FILTRATION DEVICES

BACKGROUND OF THE INVENTION

1. Field of the Invention

The present invention relates to a waste disposal assembly to be utilized for the simultaneous and efficient disposal of a plurality of fluid filtration devices in a manner which is quick, convenient, cost effective and in conformity with environmental disposal requirements such as those associated with oil filter disposal.

2. Description of the Related Art

Fluid filtration devices, and in particular oil filters are very difficult and often very expensive to properly dispose of due to the numerous environmental requirements associated with disposal of the fluid, such as oil and the contaminated filtration assembly. In particular, oil filters must be drained of a substantial quantity of the oil contained therein, and must be delivered to appropriate disposal facilities substantially separate from one another. As such, conventional compacting garbage trucks cannot be utilized for the disposal of these oil filters, because they do not provide for appropriate separation of the fluid and result in the formation of large waste blocks that include a number of oil filters compressed with one another.

Accordingly, conventional oil filter disposal requires a number of specific and often expensive steps for proper disposal. Specifically, when oil filters are removed at a servicing site, such as an automobile repair shop or oil changing station, the individual oil filters are disposed of in select drums. These drums, once filed with oil filters, are then picked up periodically by a waste disposal company, whereafter they are individually compressed, by the waste disposal company, or are brought to an appropriate disposal facility at which point they are individually compressed. In particular, the individual compression involves taking each individual oil filter and crushing it to squeeze the fluid therefrom. These individual, crushed oil filters are then appropriately disposed of as set by regulatory standards. Alternatively, if the shop owners who are doing the oil filter changes, wish to independently crush the oil filters, they may do so prior to waste pick-up. This procedure, however, still will requires that each individual oil filter be crushed to maintain separability, and while it reduces the number of pick-ups which are necessary at a particular site, it will also make the individual disposal drum substantially heavy requiring a specialized, often more expensive drum disposal equipment.

As a result, there is a substantial need in the art to solve the unaddressed and unrecognized problem of cost effective fluid filter disposal in a way that effectively removes the waste fluid and maintains the filters in appropriate form for disposal.

SUMMARY OF THE INVENTION

The present invention is directed towards a waste disposal assembly to be utilized for the simultaneous disposal of a plurality of fluid filtration devices in accordance with environmental disposal guidelines.

Specifically, the waste disposal assembly includes a main disposal housing having a disposal storage area, a fluid storage area, and a processing area. Turning to the processing area, it is structured to receive the fluid filtration devices from a servicing site for appropriate disposal processing in order to place the used filtration devices in condition for dumping at a disposal site. Accordingly, the processing area includes an exterior access through which the plurality of fluid filtration devices to be disposed of are loaded. Additionally, the processing area includes a lid member structured to cover the processing area subsequent to the loading of the plurality of fluid filtration devices therein, thereby ensuring that the contents of the processing area are appropriately contained during processing thereof.

The primary requirement for processing of the used fluid filtration devices is the removal of waste fluid from each filter while maintaining the filters loosely separable from one another. Accordingly, the processing area of the present invention includes a compactor face therein. The compactor face is structured and disposed to move within the processing area and compact the plurality of fluid filtration devices against an opposing face of the processing area. As such, the compacting results in the formation of a compressed waste block of fluid filtration devices and the squeezing of a quantity of waste fluid from each of the filtration devices.

To ensure that the fluid filtration devices do not get disposed of in the compressed waste block form, separation means are also included. The separation means are specifically structured to break up the compressed waste block, within the processing area, after the fluid filtration devices have been appropriately compacted to remove a substantial quantity of the fluid therefrom.

Finally, the processing area includes an interior access which is structured to be opened to receive the broken up, compressed waste block therethrough for passage into the disposal storage area. The disposal storage area itself is structured such that it can contain a substantial quantity of the broken up, compressed waste blocks for subsequent disposal thereof at an appropriate waste facility.

In order for the fluid squeezed from the fluid filtration devices to be appropriately disposed of, a fluid storage area is included. This fluid storage area will be structured and disposed so as to receive all of the fluid squeezed from the fluid filtration devices, as well as any fluid which drains from the broken up, compressed waste blocks in the disposal storage area, thereby providing for necessary storage of the fluid until it can be appropriately disposed of.

It is an object of the present invention to provide a waste disposal assembly which allows a number of fluid filtration devices to be effectively and efficiently disposed of at one time, while still providing for the necessary, separable disposal of the quantity of the fluid filtration devices.

Another object of the present invention is to provide a waste disposal assembly for fluid filtration devices which will substantially facilitate disposal practices at service facilities where large quantities of fluid filters are replaced.

Yet another object of the present invention is to provide a waste disposal assembly which will reduce the disposal costs and requirements of appropriately and effectively disposing of a plurality of fluid filtration devices, such as oil filters.

An additional object of the present invention is to provide a waste disposal assembly for the disposal of a plurality of fluid filtration devices which substantially removes fluid from the fluid filtration devices and maintains the fluid filtration devices in a broken up, separable state.

A further object of the present invention is to provide a waste disposal assembly which is structured to enable efficient and effective repeated fluid extraction compacting of a plurality of fluid filtration devices simultaneously without maintaining the drained fluid filtration devices in a compressed waste block.

Yet another object of the present invention is to provide a waste disposal assembly which can process a plurality of disposal batches consisting of a plurality of fluid filtration devices, effectively storing a large quantity of processed fluid filtration devices and the large quantity of fluid expelled therefrom.

Still a further object of the present invention is to provide a portable waste disposal assembly formed as part of a waste collection vehicle in order to facilitate efficient and effective site to site waste retrieval and disposal.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
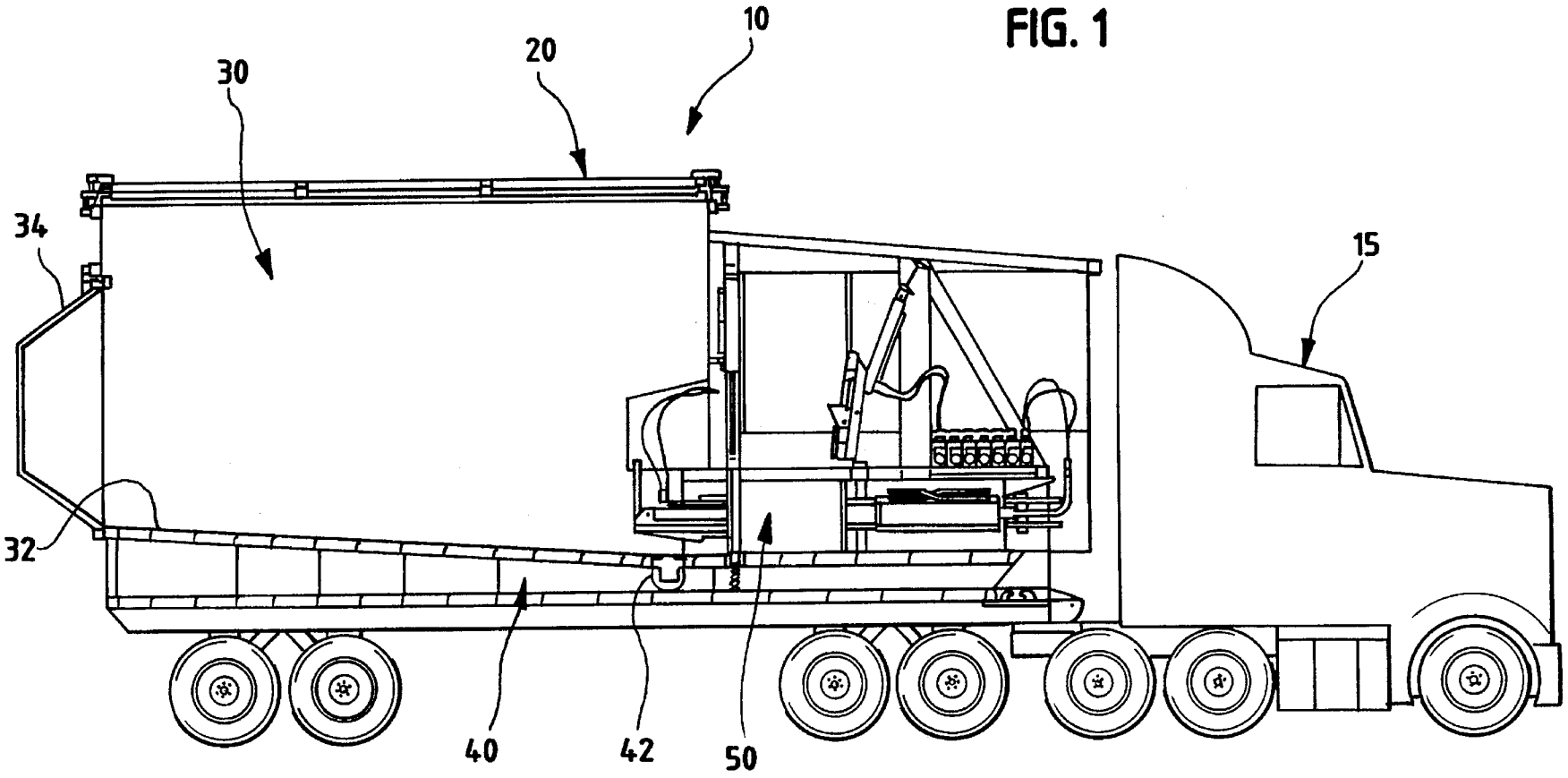
FIG. 1 is a side plan view of the waste disposal assembly of the present invention.
Figure 2:
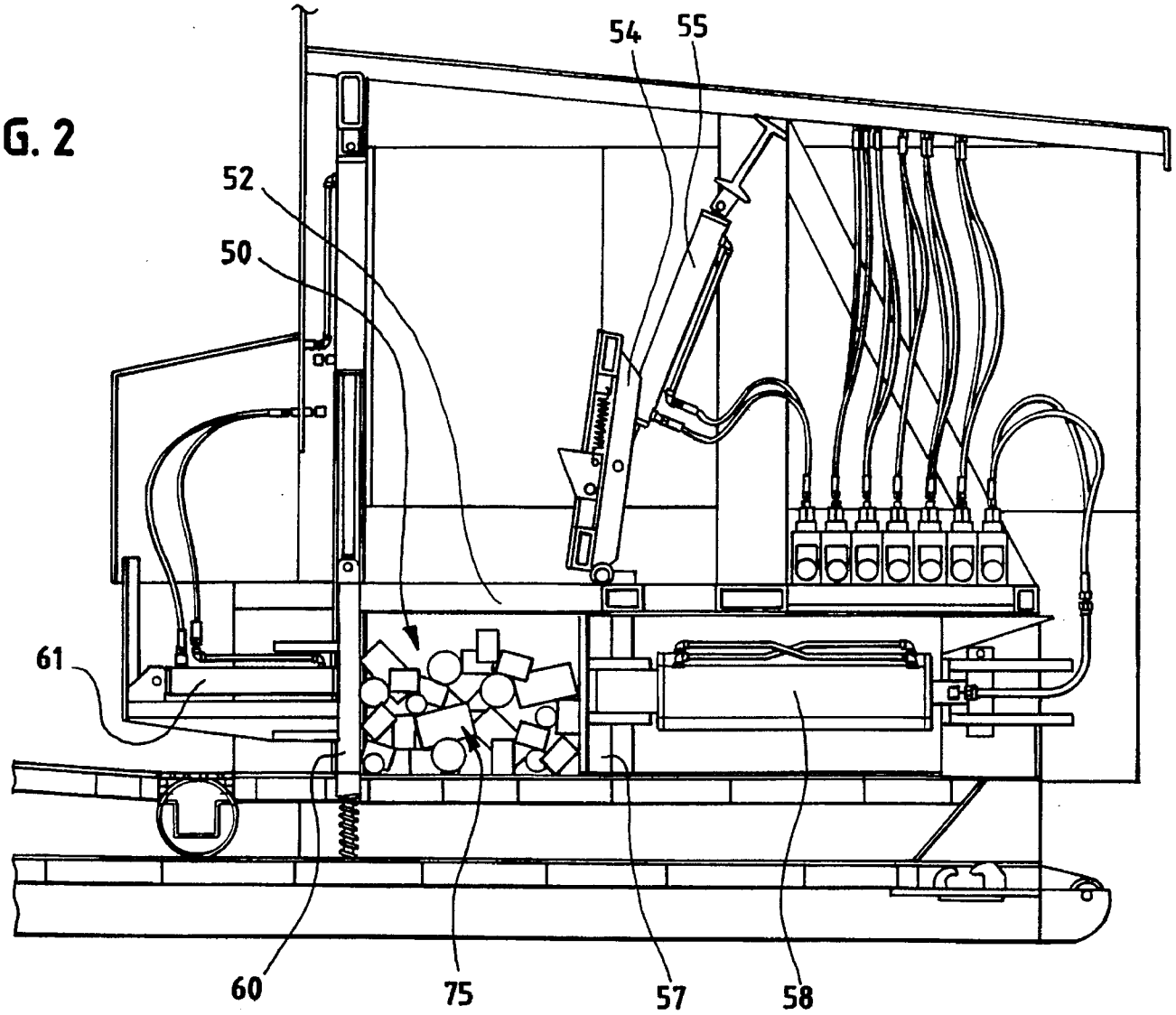
FIG. 2 is a side, isolated view of the processing area of the present invention in a loading stage.

Shown throughout the figures the present invention is directed towards waste disposal assembly, generally indicated as 10. The waste disposal assembly 10 is to be used for the simultaneous disposal of a plurality of fluid filtration devices 75 in accordance with the disposal requirements associated with fluid filtration devices such as oil filters. Preferably, the waste disposal assembly 10 of the present invention is portable and constructed as part of an overall vehicle 15, much like with conventional garbage trucks. Alternatively, however, the waste disposal assembly 10 of the present invention can be disposed on a flat bed or trailer, or otherwise be maintained in a stationary location. Nonetheless, the preferred embodiment of the present invention incorporates the waste disposal assembly as part of a vehicle so as to facilitate site to site retrieval and disposal of fluid filtration devices 75 at a variety of service locations which replace the fluid filtration devices 75.

Included in the waste disposal assembly 10 is a main disposal housing 20. This main disposal housing 20 is preferably divided into three primary compartments, namely a disposal storage area 30, a fluid storage area 40 and a processing area 50. Accordingly, the used filtration devices can be drained of the waste fluid, and stored for disposal separate from the waste fluid, all within a single, portable assembly.

Turning specifically to the processing area 50, as illustrated throughout the various drawings, the processing area 50 is structured to receive a plurality of the used fluid filtration devices 75 therein without any prior processing. Accordingly, the processing area 50 includes an exterior access 52 wherethrough the plurality of fluid filtration devices 75 are loaded into the processing area 50. In the preferred embodiment, the exterior access 52 will be an opened top of the processing area 50 as accessed through a side opening of the overall main disposal housing 20. In this regard, a hydraulic lift or other lifting means may be implemented at a side of the main disposal housing 20 such that a large disposal drum containing the plurality of used fluid filtration devices 75 therein can be safely and easily lifted and unloaded thereby into the processing area 50 through the exterior access 52. Accordingly, a disposal drum at a service site can merely be wheeled up to the main disposal housing 20 for either manual or mechanical lifting until all of its contents are unloaded into the processing area 50 for simultaneous processing thereof.

In order to maintain the processing area 50 appropriately sealed during all phases of the processing of the fluid filtration devices 75, the processing area 50 will also include a lid member 54. The lid member 54, which is preferably also at a top of the processing area 50, is structured to seal off the exterior access 52, when lowered into place atop the processing area 50, and thereby maintain all of the used fluid filtration devices contained during processing. Although the lid member 54 can be manually lowered to cover the processing area 50, subsequent to the loading of the plurality of fluid filtration devices 75, and thereafter locked or latched into place, in the preferred embodiment a hydraulic piston 55 or other mechanical means will be utilized to move the lid member 54 into a closed position. Further, the hydraulic piston 55 will function to maintain the lid member 54 in the closed position during the processing of the fluid filtration devices 75, thereby preventing accidental opening thereof and facilitating opening and closing when necessary.

Figure 3:
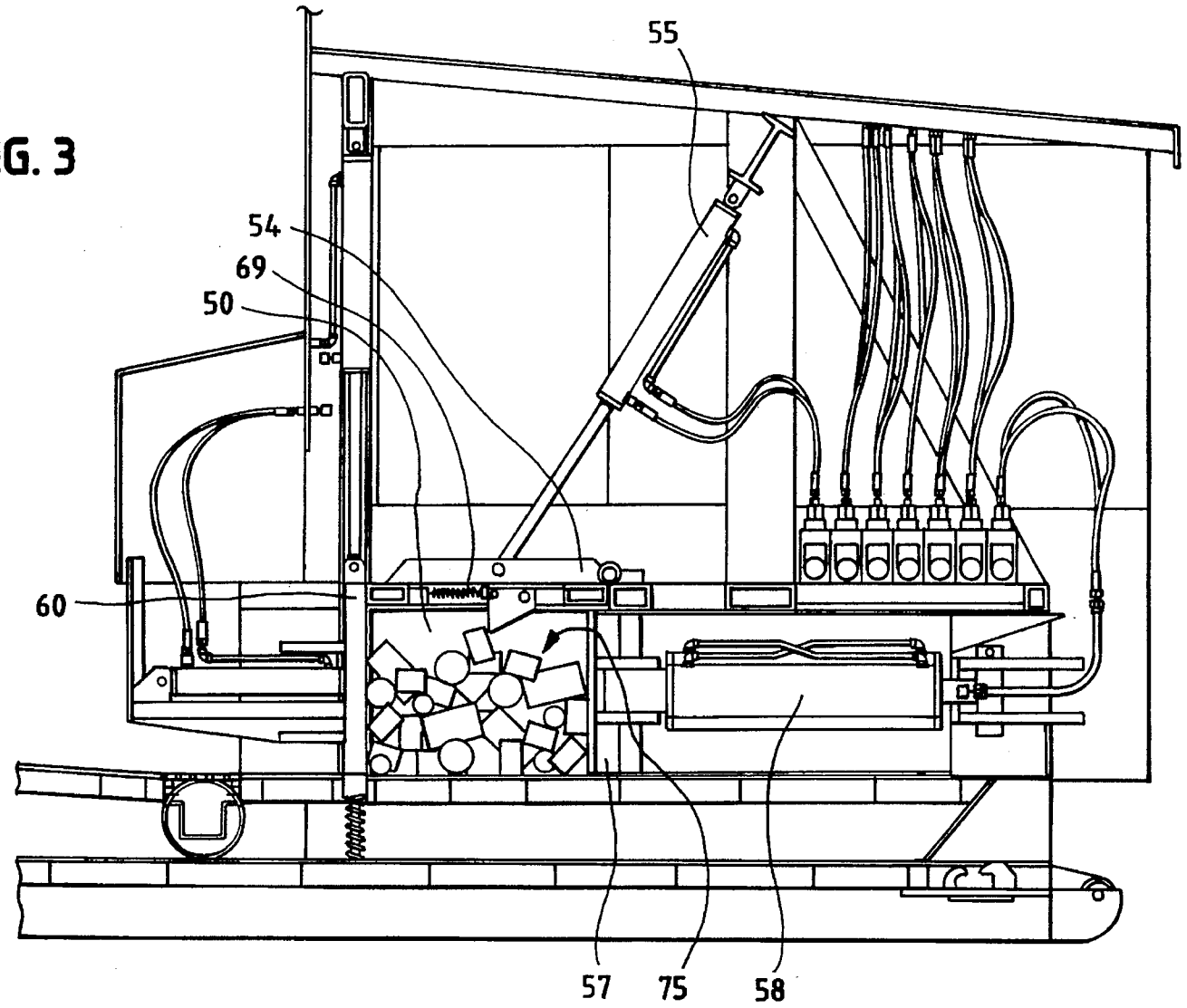
FIG. 3 is an isolated view of the processing area of the present invention in a loaded stage.
Figure 4:
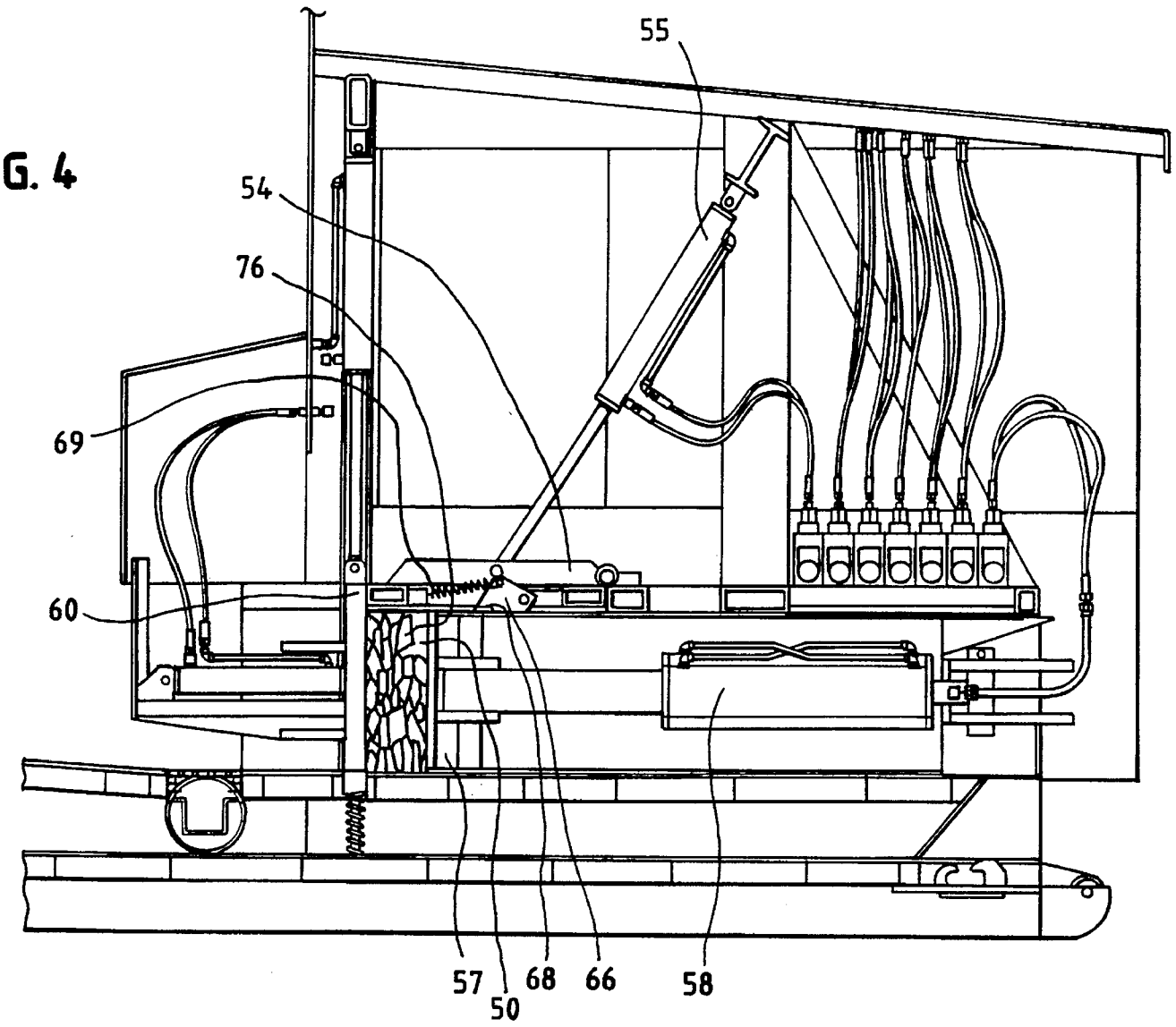
FIG. 4 is a side isolated view of the processing area of the present invention in a preliminary compacting stage.
Figure 5:
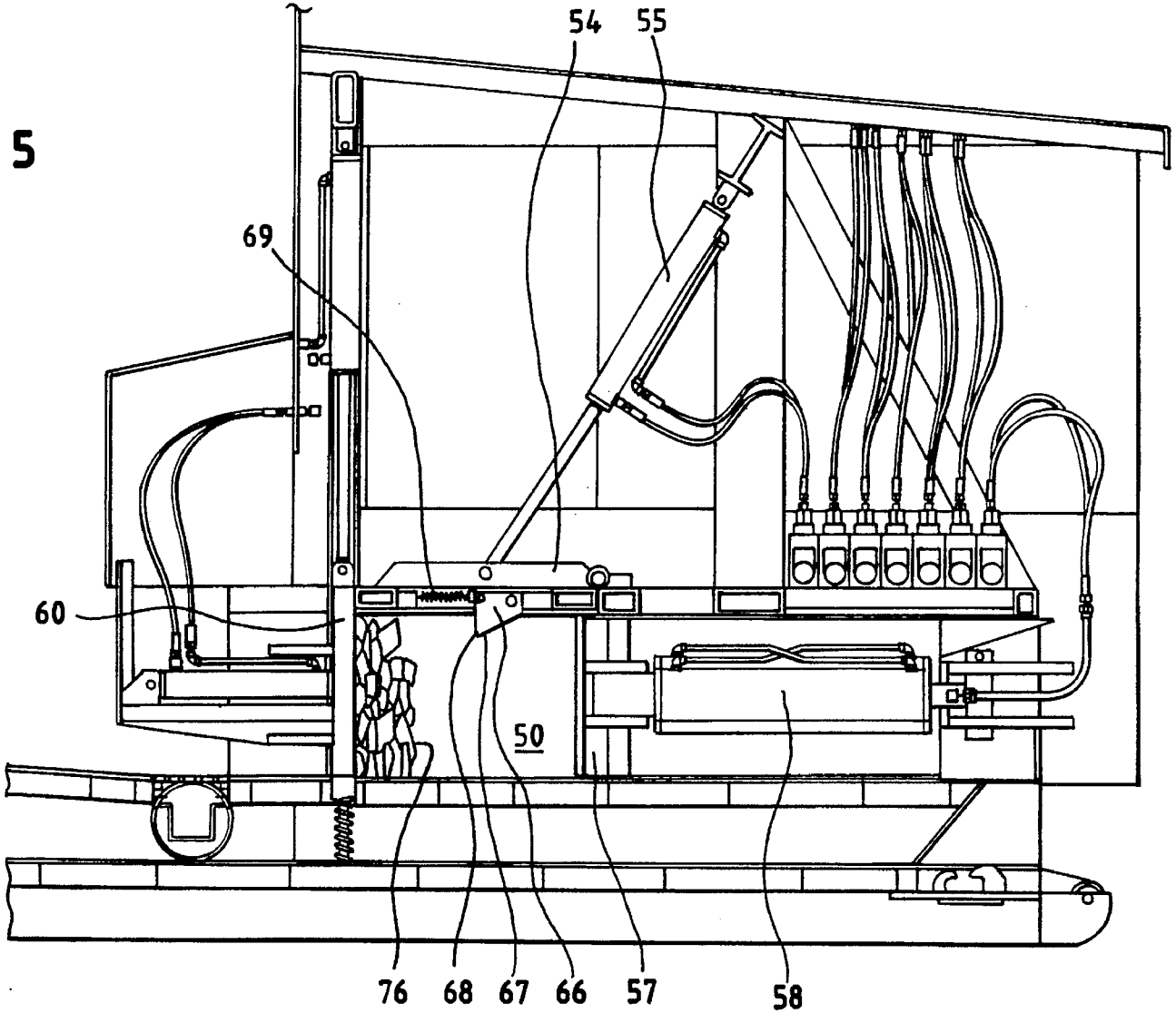
FIG. 5 is an isolated side view of the present invention in a post compacting stage.

Turning to FIGS. 3 and 4, once the plurality of fluid filtration devices 75 are appropriately loaded into the processing area 50, and the lid member 54 is appropriately positioned in covering relation thereover, a compactor face 57 of the processing area 50 is utilized to compact the fluid filtration devices 75. Specifically, the compactor face 57 is preferably incorporated into an entire side of the processing area 50 such that all of the contents of the processing area 50 will be pushed and compacted as a result of the compressing movement of the compactor face 57. Further, the compactor face 57 is structured to push all of the fluid filtration devices 75 towards an opposing face 60 of the processing area 50, which also preferably takes up an entire side of the processing area 50. Accordingly, during compacting the plurality of loose fluid filtration devices 75 will be compressed against one another and between the opposing faces so as to squeeze out a substantial quantity of the fluid contained therein. Additionally, although alternative mechanical means may be equivalently implemented, a powerful hydraulic piston 58 will preferably be disposed behind the compactor face 57 so as to push it towards the opposing face during the compacting phase and retract it once compacting is completed, thereby maximizing the compression and fluid extraction from the filtration devices.

Figure 6:
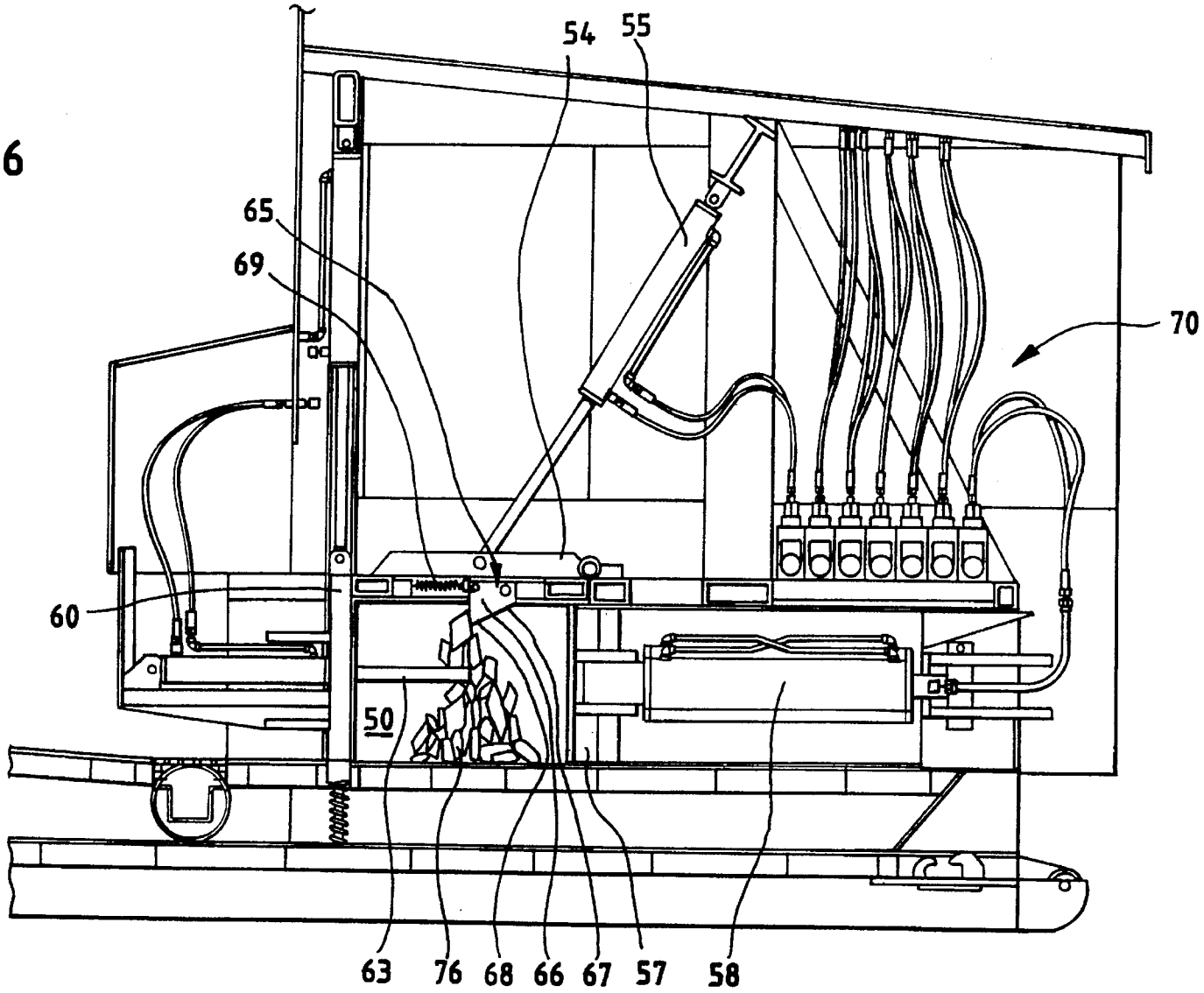
FIG. 6 is an isolated side view of an embodiment of the processing area of the present invention in a separation stage.
Figure 6A:
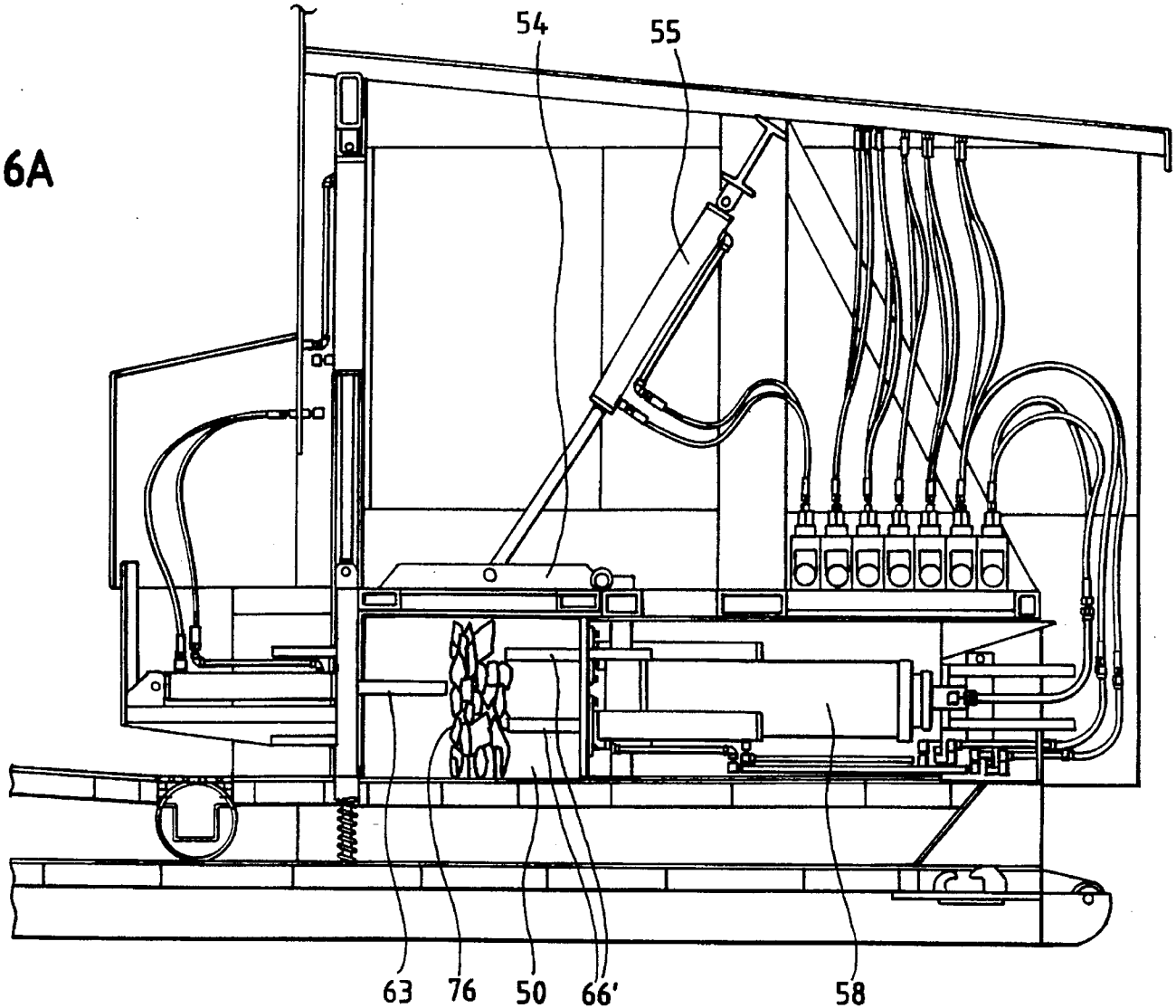
FIG. 6A is an isolated side view of another embodiment of the processing area of the present invention in a separation stage.

Unfortunately, however, in addition to squeezing a substantial quantity of waste fluid from the fluid filtration devices, the compression of the fluid filtration devices between the compactor face 57 and its opposing face will also form a compressed waste block 76. Therefore, as illustrated in FIG. 6 and 6A, the processing area 50 will also include separation means 65 structured to break up the compressed waste block 76 within the processing area 50. Specifically, because the used filtration devices cannot be appropriately disposed of as a single compressed waste block 76, they must be substantially broken up and separated from one another. Although a variety of separation means 65 can be implemented, in a preferred embodiment, as shown in FIG. 6, the separating means 65 include a uni-direction breaking member 66 and a pushing member 63. Specifically, the pushing member 63, which preferably extends from the opposing face 60 of the processing area 50, is structured to urge the compressed waste block 76 back towards the retracted compactor face 57 and accordingly the uni-directional breaking member 66. The uni-direction breaking member 66, which can be disposed on any of a number of faces within the processing area 50, preferably protrudes downwardly from the lid member 54 so as to maximize gravitational effects during the break up process.

Figure 7:
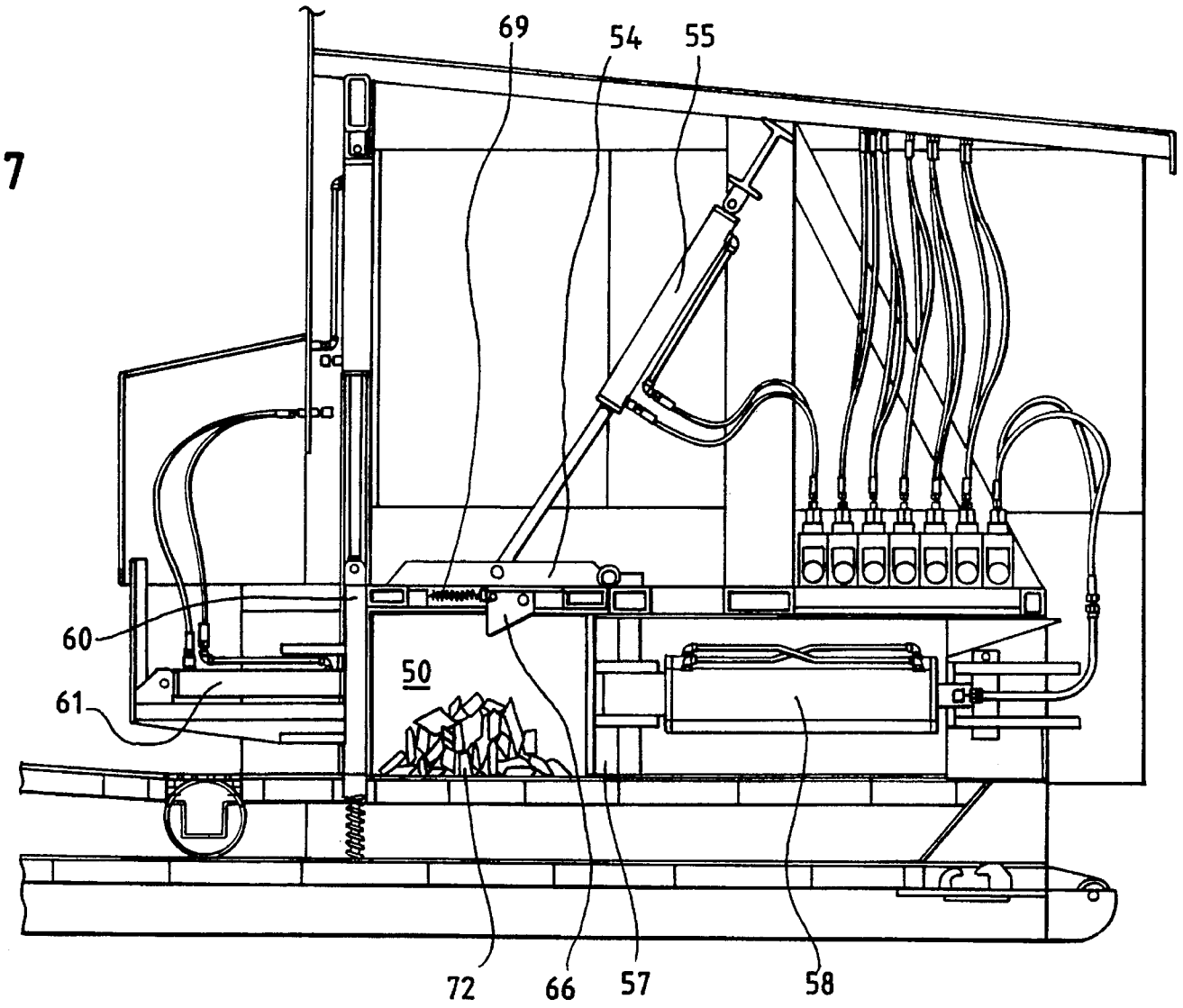
FIG. 7 is an isolated side view of the embodiment of the processing area of the present invention illustrated in FIG. 6 in a broken up, pre-compacting or pre-disposal stage.

The uni-direction breaking member 66 of the preferred embodiment of FIGS. 6 and 7 includes a pivotally secured rigid panel having a slopped face 67 terminating in a primary breaking point 68. The primary breaking point 68 defines the bottom of a flat side which engages the compressed waste block 76 as it is urged towards the compactor face 57. As such, when a top portion of the compressed waste block 76 is engaged by the breaking point 68, the continuing force of the pushing member 63 towards to compactor face 57 will result in the compressed waste block 76 breaking up as illustrated in FIG. 6. Additionally, and in order to enable proper operation of the disposal assembly in the compacting phase of the processing wherein the compactor face 57 moves towards the opposing face 60 and over the uni-directional breaking member 66, the uni-directional breaking member 66 is structured to be substantially retracted into the lid member 65. In particular, the slopped surface 67 is preferably disposed such that when the compactor face 57 moves onto the uni-directional breaking member 66, it will ride onto the slopped face 67 so as to guide the entire uni-directional breaking member 66 up into its retracted position within the lid member 65. Further, the uni-directional breaking member 66 is preferably connected to biasing means which are preferably in the form of a spring 69 structured to ensure that the uni-directional breaking member 66 will return to its extended position within the processing area 50 subsequent to the compactor face 57 returning to its normal pre-compacting position. Also, as illustrated in FIG. 4, the compactor face 57 may be structured such that it will remain engaged with the uni-directional breaking member 66 during the entire compacting phase. Accordingly, the uni-directional breaking member 66 will not accidentally spring into an engaged position behind the compactor face 57 preventing retraction thereof. In additional embodiments, however, other means of maintaining the uni-direction breaking member 66 retracted, such as a magnet or latch which is activated during the compacting phase can also be equivalently effective to ensure that the uni-directional breaking member 66 does not restrict the compactor face 57 from returning to its normal position. Such alternative retraction maintenance means will preferably be implemented if the pushing member 63 extends from the compactor face 57 or a side face rather than the opposing face, so long as the uni-directional breaking member is properly oriented.

Figure 7A:
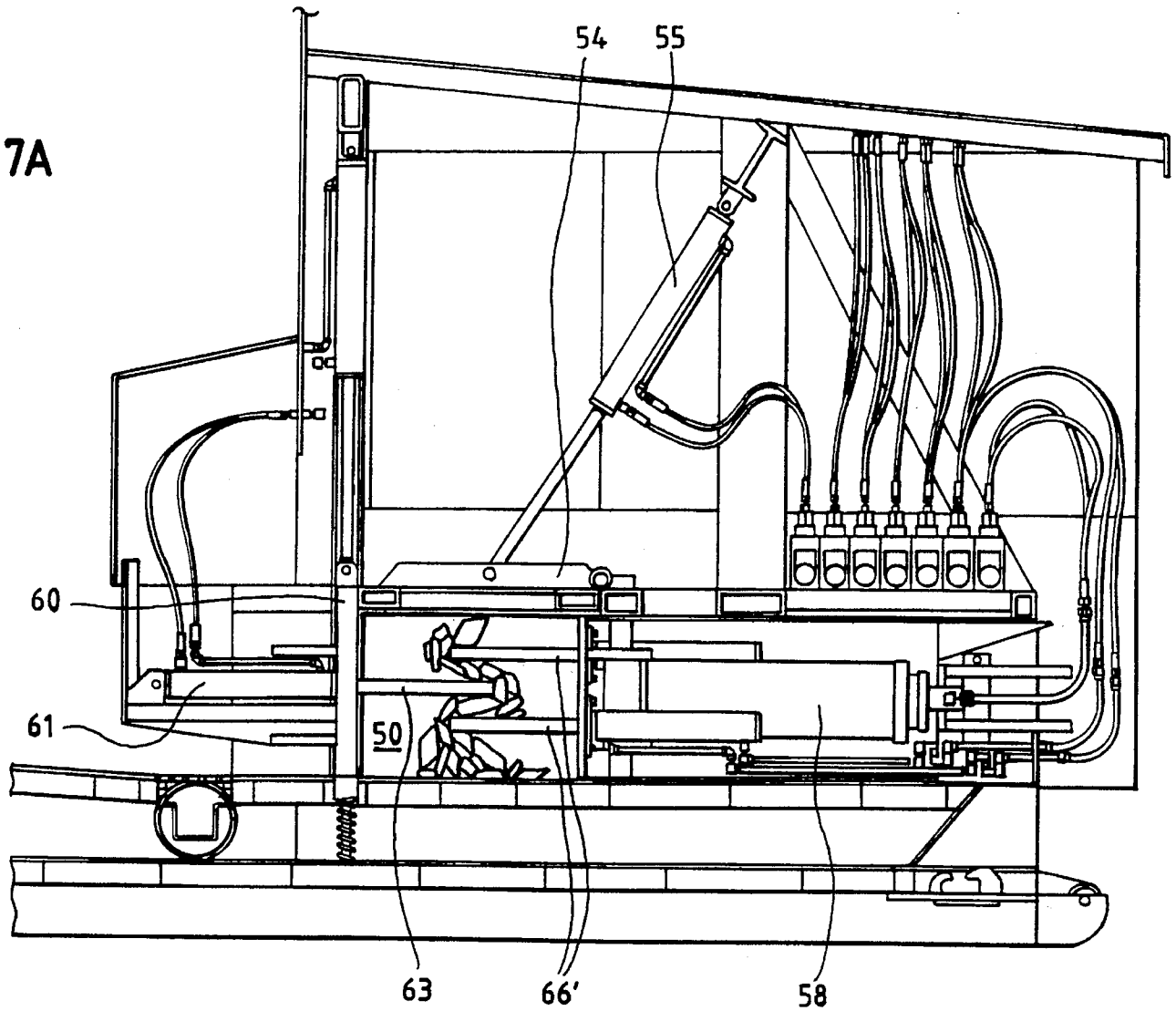
FIG. 7A is an isolated side view of the embodiment of the processing area illustrated in FIG. 6A in a broken up, pre-compacting or pre-disposal stage.
Figure 8:
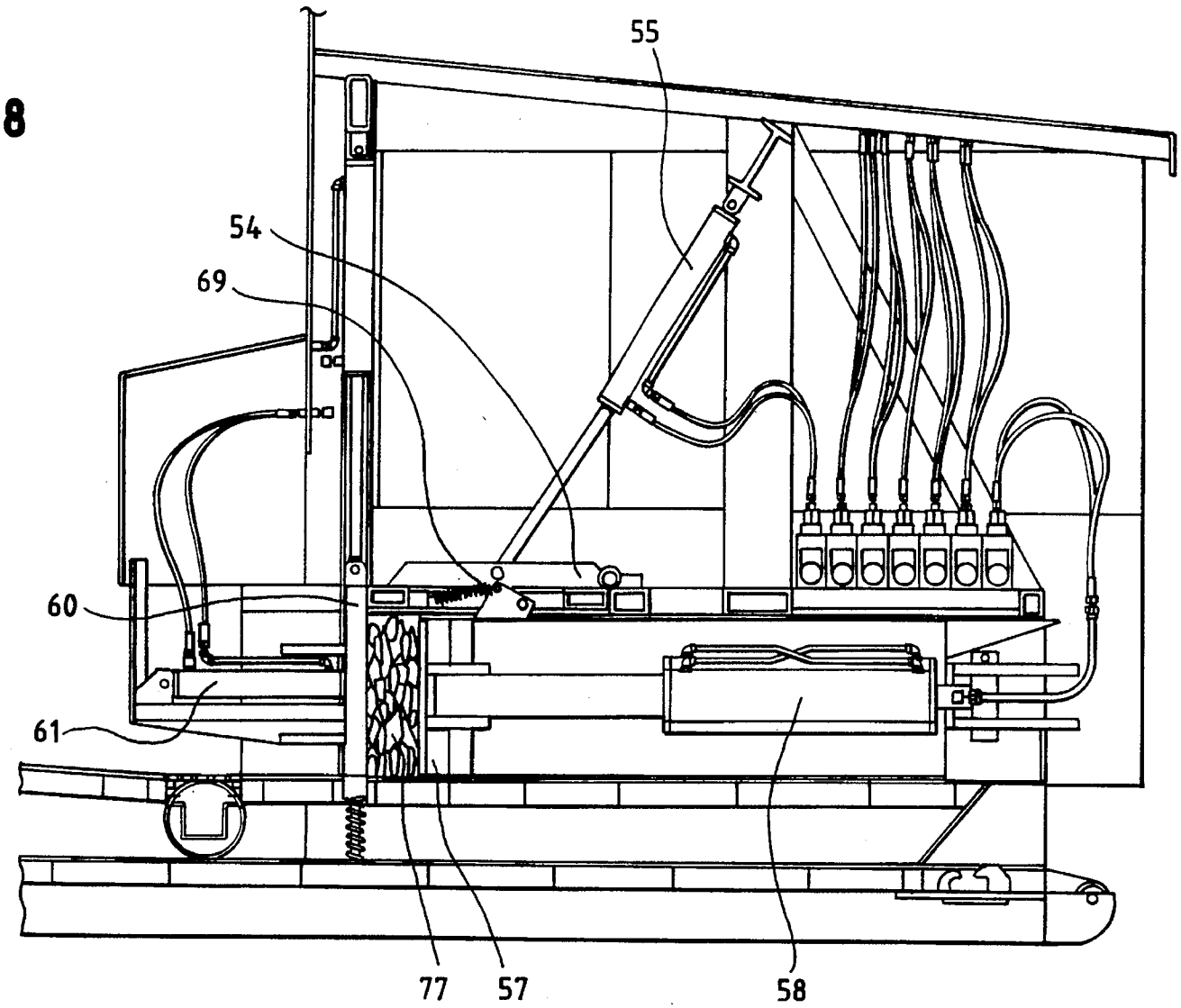
FIG. 8 is an isolated side view of the processing area of the present invention in a secondary compacting stage.
Figure 9:
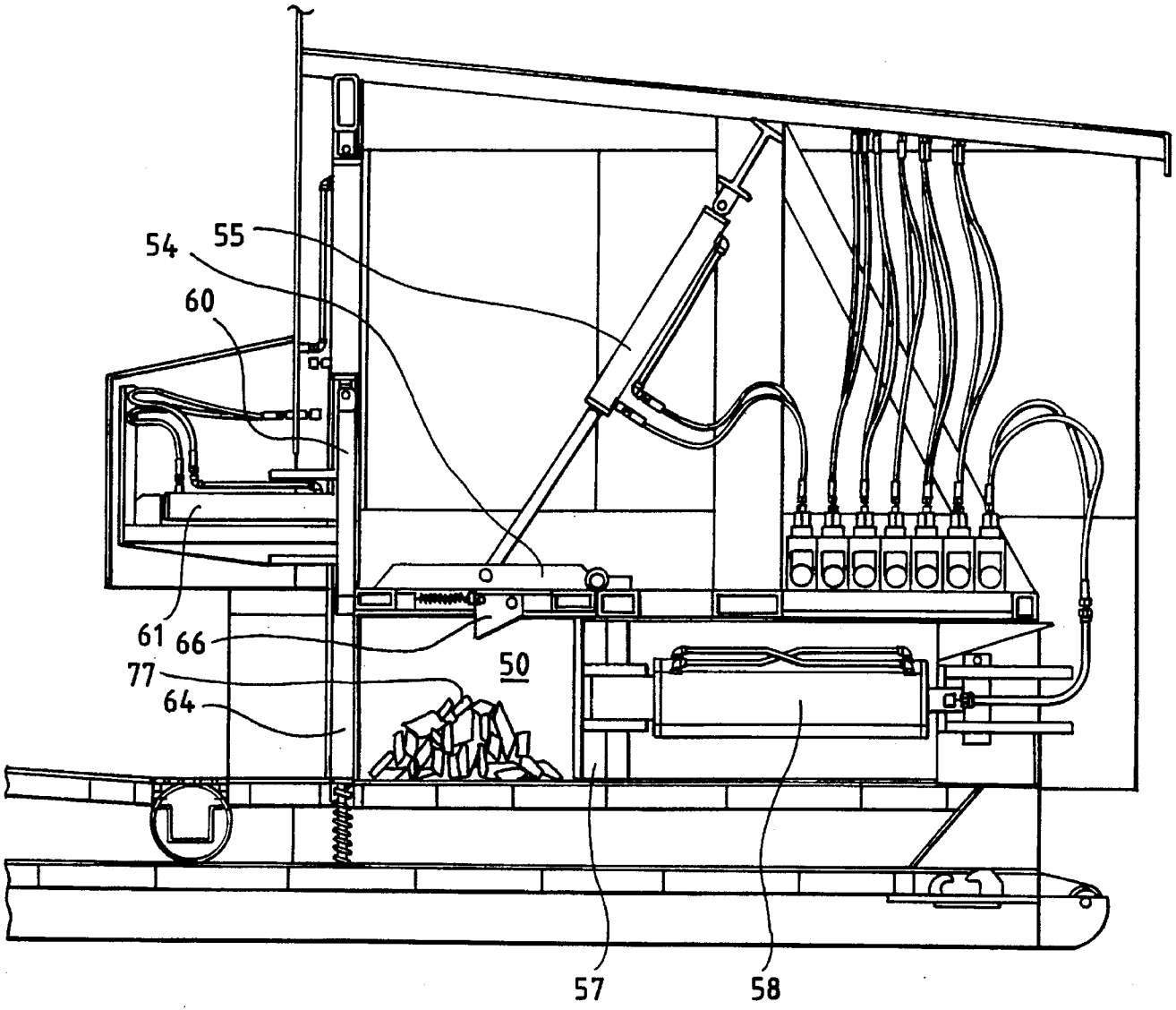
FIG. 9 is an isolated side view of the processing area of the present invention in a final disposal stage.

Preferably the pushing member 63 will be hydraulically, or otherwise mechanically driven. Further, in an alternative embodiment, as in FIGS. 6A and 7A, at least one, but preferably two or more of the uni-directional breaking members 66' are included and will also hydraulically, or otherwise mechanically extend into the processing area 50 for breaking up of the compressed waste block. Specifically, in the embodiment of FIGS. 6A and 7A, the uni-directional breaking members include a pair of spaced rods which extend into the processing area in an opposing direction from the pushing member 63, which includes a similar elongate rod. Accordingly, as the rods overlap the compressed waste block will be substantially broken up, after which the rods retract to allow for a subsequent compacting or unloading phase. Nonetheless, the pushing member(s) and/or the uni-directional breaking member(s) can extend from any face within the processing area, including the side faces, the lid member or a bottom surface, and can extend from multiple faces in multiple directions.

Finally, the processing area 50 will also include an interior access 64. This interior access 64 will preferably be included at the opposing face 60 of the processing area 50 such that when necessary compacting of the fluid filtration devices 75 has been completed and the broken up filtration devices 77 are ready for disposal, the opposing face 60 can retract, preferably via a hydraulic member 61, to open the interior access 64 and allow the broken up, compressed waste block 77 to pass therethrough into the disposal storage area 30. Preferably, the broken up, compressed waste block 77 is pushed into the disposal storage area 30 through the interior access 64 by the compactor face 57, after which the opposing face 60 returns to its closed position and the lid member 54 opens to allow access to a further plurality of fluid filtration devices 75 into the processing area 50.

Returning to FIG. 1, the disposal storage area 30 will be substantially large such that it can contain a large quantity of the broken up, compressed waste blocks 77 therein. In use, as further broken up compressed waste blocks 77 are pushed into the disposal storage area 30, previously processed broken up, compressed waste blocks 77 are pushed towards a rear disposal access 34 of the disposal storage area 30. Accordingly, through the disposal access 34 the broken up, compressed waste blocks 77, which consist of the plurality of fluid filtration devices 75, can be unloaded for proper disposal at a disposal facility.

Additionally, the disposal storage area 30 includes a slopped bottom surface 32. This slopped bottom surface 32 directs fluid, which may continue to drain from the broken up, compressed waste blocks 77 contained within the disposal area 30, downwardly therealong to a drainage access 42. Accordingly, any excess fluid which did not effectively drain during the compacting phase will also be eliminated as the processed fluid filtration devices 75 await disposal.

The drain 42 is structured to provide access to the fluid storage area 40, which preferably extends along an entire lower surface of the main disposal housing 20. The drainage access 42 is disposed at a lower most point in the processing area such that the normal effects of gravity will result in fluid effectively flowing through the drainage access 42 for subsequent storage within the fluid storage area. In addition to accepting draining fluid from the disposal storage area 30, the drainage access 42 is disposed such that the fluid squeezed from the fluid filtration devices 75, upon compacting thereof, will also flow therein. Although a separate drain may be included within the processing area 50, in the preferred embodiment small flow through slot will be included in the opposing face 60 through which the fluid squeezed from the fluid filtration devices 75 passes for drainage through the drainage access 42.

Further, in alternative embodiments, the drainage access 42 may include a pump or other drainage assistance means to draw waste fluid therethrough into the fluid storage area. Along these lines, although the preferred embodiment of the present invention incorporates the fluid storage area along the lower surface of the main disposal housing 20, the fluid storage area can equivalently be annexed to the main disposal housing or be located in a variety of other locations in the main disposal housing 20. In these instances, the pump or other mechanism will function to direct the fluid that passes through the drainage access 42 into the fluid storage area. Also, the waste fluid, which is stored within the fluid storage area until it can be appropriately evacuated and disposed of in an acceptable disposal facility, may be drained by a separate drainage port or be pumped directly from the drainage access 42. If a separate port is included it may provide for gravitational drainage or pumped drainage.

As previously described, opening and closing of the lid member, opening and closing of the opposing face 60, movement of the pushing member 63 and movement of the compactor face 57 will all preferably be directed by hydraulic pistons. Although alternative means may effectively be utilized such as manual opening and closing and/or mechanically actuated maneuvering utilizing gears, cams and the like, the preferred embodiment will include hydraulic actuation. As a result, a plurality of hydraulic compressors 70 will preferably be located within the main disposal housing 20. Further, although individual and/or manual initiation of the various processing phases may be implemented, in order to more effectively direct and regulate the various phases of the disposal process, control means are preferably included. The control means can be any conventional type of control means, such as an on-line computer control, and will be structured so as to direct the various phases of operation, whether mechanical or hydraulic. Further, the control means will preferably direct more than one compacting and separation phase so as to ensure that a maximum quantity of fluid is squeezed from the fluid filtration devices 75. As such, the control means will direct the opening and closing of the lid member 54, the slided movement of compactor face 57, the pushing movement of the pushing member 63 and/or uni-directional breaking member, and the opening and closing of the opposing face 60.

In addition to the waste disposal assembly 10 previously recited, the present invention is also directed towards a method of disposing of a plurality of fluid filtration devices 75 simultaneously and according to environmental disposal guidelines. The first step involved in the method includes loading the plurality of fluid filtration devices 75 into a processing area. Next, the plurality of fluid filtration devices are compacted so as to squeeze out a waste fluid therefrom and form a compressed waste block. This step is followed by draining the fluid from the processing area and breaking up the compressed waste block to form a broken up, compressed waste block. In the preferred embodiment, these steps will be followed by further compacting the broken up, compressed waste block so as to squeeze out further quantities of fluid therefrom and re-form the compressed waste block, draining the fluid from the processing area once again, and breaking up the re-formed compressed waste block. Finally, the broken up, compressed waste block is emptied into a disposal storage area and stored for effective and appropriate disposal thereof in an acceptable disposal facility.

While this invention has been shown and described in what is considered to be a practical and preferred embodiment, it is recognized that departures may be made within the spirit and scope of this invention which should, therefore, not be limited except as set forth in the claims which follow and within the doctrine of equivalents.

Now that the invention has been described:

What is claimed:

1. A waste disposal assembly to be used for the simultaneous disposal of a plurality of fluid filtration devices, said waste disposal assembly comprising:

(a) a main disposal housing, said main disposal housing including a disposal storage area, a fluid storage area, and a processing area, (b) said processing area including:

an exterior access wherethrough the plurality of fluid filtration devices are loaded into said processing area, a lid member structured to cover said processing area subsequent to the loading of the plurality of fluid filtration devices therein, a compactor face structured and disposed to compact the plurality of fluid filtration devices within said processing area against an opposing face of said processing area so as to squeeze fluid from the plurality of fluid filtration devices and form a compressed waste block from the plurality of fluid filtration devices, separation means structured and disposed to break up said compressed waste block within said processing area, an interior access structured and disposed to be opened to receive the broken up, compressed waste block therethrough for passage into said disposal storage area, (c) said disposal storage area being structured to contain a substantial quantity of the broken up, compressed waste blocks for subsequent disposal thereof in an appropriate waste facility, and (d) said fluid storage area being structured and disposed to receive the fluid squeezed from the plurality of fluid filtration devices and drained from the broken up, compressed waste blocks for subsequent disposal in an appropriate fluid waste facility.

2. A waste disposal assembly as recited in claim 1 wherein said main disposal housing is disposed on a vehicle.

3. A waste disposal assembly as recited in claim 1 wherein said opposing face of said processing area against which the plurality of fluid filtration devices is compacted includes said interior access such that upon said interior access being in an open orientation said compactor face will push said broken up, compressed waste block therethrough into said disposal storage area.

4. A waste disposal assembly as recited in claim 1 wherein said separation means includes a uni-directional breaking member extending into said processing area and structured to break up said compressed waste block upon said compressed waste block being pushed within said processing area towards said uni-directional breaking member, while not obstructing compacting movement of said compactor face towards said opposing face.

5. A waste disposal assembly as recited in claim 4 wherein said separation means further includes at least one pushing member extending from said opposing face of said processing area and structured to push said compressed waste block over said uni-directional breaking member for breaking up thereof.

6. A waste disposal assembly as recited in claim 4 wherein said uni-directional breaking member is structured to retract upon passage of the plurality of fluid filtration devices and said compactor face thereover towards said opposing face and remain in said retracted orientation until said compactor face returns to its normal, pre-compacting position.

7. A waste disposal assembly as recited in claim 4 wherein said uni-directional breaking member protrudes from said lid member.

8. A waste disposal assembly as recited in claim 4 wherein said uni-directional breaking member protrudes from said compactor face.

9. A waste disposal assembly as recited in claim 8 wherein said uni-directional breaking member is hydraulically extended into said processing area and retracted through said compactor face.

10. A waste disposal assembly as recited in claim 8 wherein said separation means further includes at least one pushing member extending from said opposing face of said processing area and structured to push said compressed waste block into said uni-directional breaking member for breaking up thereof.

11. A waste disposal assembly as recited in claim 4 wherein said uni-directional breaking member protrudes from said opposing face.

12. A waste disposal assembly as recited in claim 1 further including control means structured and disposed to direct at least one complete compacting and break up phase within said processing area prior passage of said broken up, compressed waste block through said interior access into said disposal storage area.

13. A waste disposal assembly as recited in claim 12 wherein said control means are further structured to open said interior access and direct said compactor face to push said broken up, compressed waste block therethrough into said disposal storage area.

14. A waste disposal assembly as recited in claim 12 wherein said control means are structured and disposed to direct a plurality of complete compacting and break up phase within said processing area prior passage of said broken up, compressed waste block through said interior access into said disposal storage area.

15. A waste disposal assembly as recited in claim 1 wherein said fluid storage area includes a storage compartment disposed along a lower surface of said main disposal housing and including a drainage access structured to receive the fluid squeezed from the plurality of fluid filtration devices and drained from the broken up, compressed waste block therethrough.

16. A waste disposal assembly as recited in claim 15 wherein said disposal storage area includes a slopped bottom surface to facilitate drainage of fluid from said broken up, compressed waste blocks contained therein.

17. A portable waste disposal assembly to be used for the simultaneous disposal of a plurality of fluid filtration devices, said waste disposal assembly comprising:

(a) a main disposal housing, said main disposal housing including a disposal storage area, a fluid storage area, and a processing area, (b) said processing area including:

an exterior access wherethrough the plurality of fluid filtration devices are loaded into said processing area, a lid member structured to cover said processing area subsequent to the loading of the plurality of fluid filtration devices therein, a compactor face structured and disposed to compact the plurality of fluid filtration devices within said processing area against an opposing face of said processing area so as to squeeze fluid from the plurality of fluid filtration devices and form a compressed waste block from the plurality of fluid filtration devices, separation means structured and disposed to break up said compressed waste block within said processing area, an interior access structured and disposed to be opened to receive the broken up, compressed waste block therethrough for passage into said disposal storage area, (c) said disposal storage area being structured to contain a substantial quantity of the broken up, compressed waste blocks for subsequent disposal thereof in an appropriate waste facility, (d) said fluid storage area being structured and disposed to receive the fluid squeezed from the plurality of fluid filtration devices and drained from the broken up, compressed waste blocks for subsequent disposal in an appropriate fluid waste facility, and (e) transportation means structured and disposed to transport said main disposal housing to various locations.

* * * * *